US010640849B1

(12) United States Patent
Cui et al.

(10) Patent No.: US 10,640,849 B1
(45) Date of Patent: May 5, 2020

(54) NICKEL-BASED SUPERALLOY AND ARTICLES

(71) Applicant: General Electric Company, Schenectady, NY (US)

(72) Inventors: Yan Cui, Greer, SC (US); Michael Douglas Arnett, Simpsonville, SC (US); Matthew Joseph Laylock, Easley, SC (US); Brian Lee Tollison, Honea Path, SC (US); Brad Wilson VanTassel, Easley, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/185,185

(22) Filed: Nov. 9, 2018

(51) Int. Cl.
*C22C 19/05* (2006.01)

(52) U.S. Cl.
CPC ..... *C22C 19/056* (2013.01)

(58) Field of Classification Search
CPC ..... C22C 19/058; C22C 19/056
See application file for complete search history.

(56) References Cited

U.S. PATENT DOCUMENTS

| | | | |
|---|---|---|---|
| 4,460,542 | A | 7/1984 | Herchenroeder |
| 8,858,876 | B2 | 10/2014 | Zhang |
| 2011/0062220 | A1 | 3/2011 | Feng |

FOREIGN PATENT DOCUMENTS

| | | | |
|---|---|---|---|
| EP | 1193321 | A | 4/2002 |
| JP | H04358037 | A | 12/1992 |
| JP | H0533092 | A | 2/1993 |
| WO | 2011041183 | A1 | 4/2011 |

OTHER PUBLICATIONS

EP Search Report and Written Opinoin for corresponding EP Application No. 19207823.6 dated Mar. 9, 2020, 6 pgs.

*Primary Examiner* — Jessee R Roe
(74) *Attorney, Agent, or Firm* — Hoffman Warnick LLC

(57) ABSTRACT

A composition of matter includes from about 16 to about 20 wt % chromium, greater than 6 to about 10 wt % aluminum, from about 2 to about 10 wt % iron, less than about 0.04 wt % yttrium, less than about 12 wt % cobalt, less than about 1.0 wt % manganese, less than about 1.0 wt % molybdenum, less than about 1.0 wt % silicon, less than about 0.25 wt % carbon, about 0.03 wt % boron, less than about 1.0 wt % tungsten, less than about 1.0 wt % tantalum, about 0.5 wt % titanium, about 0.5 wt % hafnium, about 0.5 wt % rhenium, about 0.4 wt % lanthanide elements, and the balance being nickel and incidental impurities. This nickel-based superalloy composition may be used in superalloy articles, such as a blade, nozzle, a shroud, a splash plate, a squealer tip of the blade, and a combustor of a gas turbine engine.

20 Claims, 1 Drawing Sheet

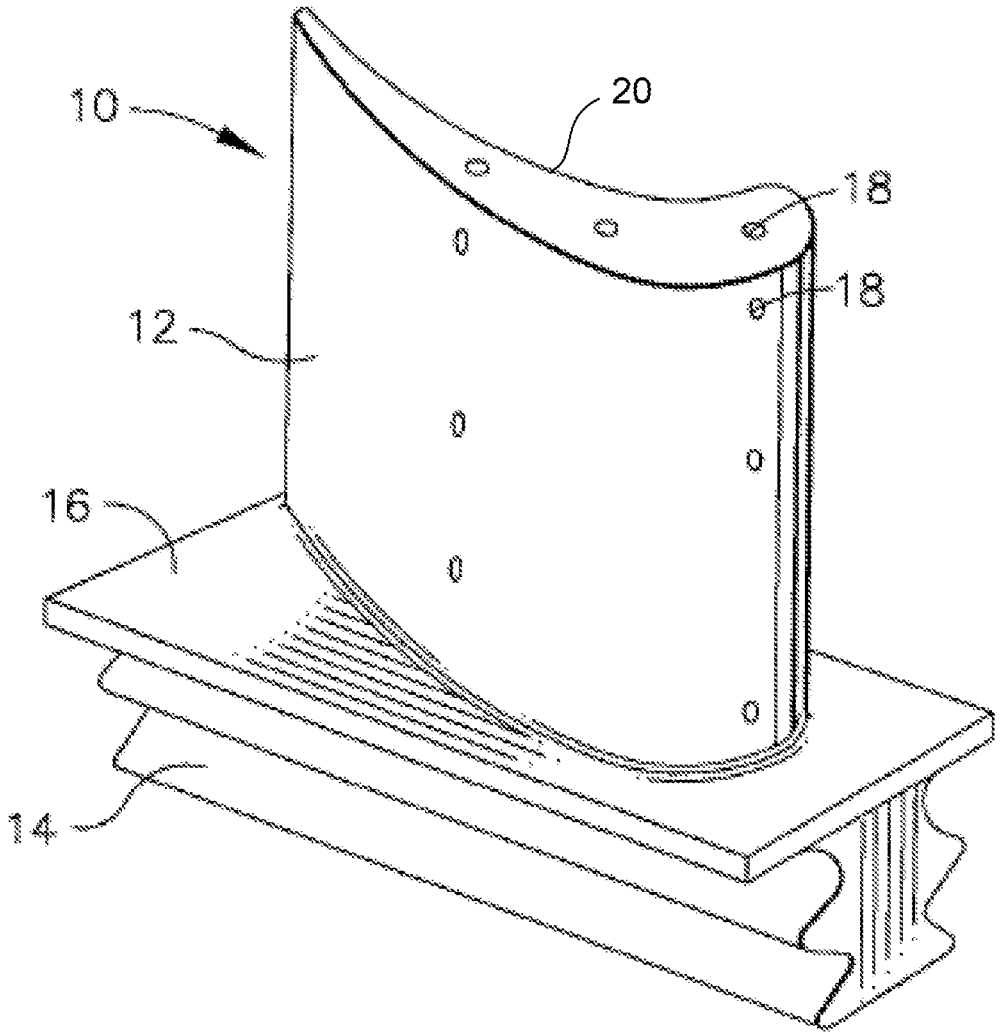
10
20
18
18
12
16
14

NICKEL-BASED SUPERALLOY AND ARTICLES

BACKGROUND OF THE INVENTION

This invention relates generally to compositions of matter suitable for use in aggressive, high-temperature gas turbine environments, and articles made therefrom.

Nickel-based superalloys are used extensively throughout the turbomachines in turbine blade, nozzle, and shroud applications. Turbomachine designs for improved engine performance demand alloys with increasingly higher temperature capability, primarily in the form of improved creep strength (creep resistance). Alloys with increased amounts of solid solution strengthening elements such as Ta, W, Re, and Mo, which also provide improved creep resistance, generally exhibit decreased phase stability, increased density, and lower environmental resistance. Recently, thermal-mechanical fatigue (TMF) resistance has been a limiting design criterion for turbine components. Temperature gradients create cyclic thermally induced strains that promote damage by a complex combination of creep, fatigue, and oxidation. Directionally solidified superalloys have not historically been developed for cyclic damage resistance. However, increased cyclic damage resistance is desired for improved engine efficiency.

Superalloys may be classified into four generations based on similarities in alloy compositions and high temperature mechanical properties. So-called first generation superalloys contain no rhenium. Second generation superalloys typically contain about three weight percent rhenium. Third generation superalloys are designed to increase the temperature capability and creep resistance by raising the refractory metal content and lowering the chromium level. Exemplary alloys have rhenium levels of about 5.5 weight percent and chromium levels in the 2-4 weight percent range. Fourth and fifth generation alloys include increased levels of rhenium and other refractory metals, such as ruthenium.

Second generation alloys are not exceptionally strong, although they have relatively stable microstructures. Third and fourth generation alloys have improved strength due to the addition of high levels of refractory metals. For example, these alloys include high levels of tungsten, rhenium, and ruthenium. These refractory metals have densities that are much higher than that of the nickel base, so their addition increases the overall alloy density. For example, fourth generation alloys may be about 6% heavier than second generation alloys. The increased weight and cost of these alloys limit their use to only specialized applications. Third and fourth generation alloys are also limited by microstructural instabilities, which can impact long-term mechanical properties.

Each subsequent generation of alloys was developed in an effort to improve the creep strength and temperature capability of the prior generation. For example, third generation superalloys provide a 50° F. (about 28° C.) improvement in creep capability relative to second generation superalloys. Fourth and fifth generation superalloys offer a further improvement in creep strength achieved by high levels of solid solution strengthening elements such as rhenium, tungsten, tantalum, molybdenum and the addition of ruthenium.

As the creep capability of directionally solidified superalloys has improved over the generations, the continuous-cycle fatigue resistance and the hold-time cyclic damage resistance have also improved. These improvements in rupture and fatigue strength have been accompanied by an increase in alloy density and cost, as noted above. In addition, there is a microstructural and environmental penalty for continuing to increase the amount of refractory elements in directionally solidified superalloys. For example, third generation superalloys are less stable with respect to topological close-packed phases (TCP) and tend to form a secondary reaction zone (SRZ). The lower levels of chromium, necessary to maintain sufficient microstructural stability, results in decreased environmental resistance in the subsequent generations of superalloys.

Cyclic damage resistance is quantified by hold time or sustained-peak low cycle fatigue (SPLCF) testing, which is an important property requirement for single crystal turbine blade alloys. The third and fourth generation superalloys have the disadvantages of high density, high cost due to the presence of rhenium and ruthenium, microstructural instability under coated condition (SRZ formation), and inadequate SPLCF lives.

Accordingly, it is desirable to provide superalloy compositions that contain less rhenium and ruthenium, have longer SPLCF lives, and have improved microstructural stability through less SRZ formation, while maintaining adequate creep and oxidation resistance.

BRIEF DESCRIPTION OF THE INVENTION

Fatigue resistant nickel-based superalloys for turbine blade applications that provide lower density, low rhenium and ruthenium content, low cost, improved SPLCF resistance, and less SRZ formation compared to known alloys as well as balanced creep and oxidation resistance are described in various exemplary embodiments.

According to one aspect, a composition of matter comprises from about 16 to about 20 wt % chromium, greater than 6 to about 10 wt % aluminum, from about 2 to about 10 wt % iron, less than about 0.04 wt % yttrium, less than about 12 wt % cobalt, less than about 1.0 wt % manganese, less than about 1.0 wt % molybdenum, less than about 1.0 wt % silicon, less than about 0.25 wt % carbon, about 0.03 wt % boron, less than about 1.0 wt % tungsten, less than about 1.0 wt % tantalum, about 0.5 wt % titanium, about 0.5 wt % hafnium, about 0.5 wt % rhenium, about 0.4 wt % lanthanide elements, and the balance being nickel and incidental impurities. This nickel-based superalloy composition may be used in superalloy articles, such as a blade, nozzle, a shroud, a splash plate, a squealer tip of the blade, and a combustor of a gas turbine engine.

According to another aspect, an article is comprised of a composition of matter, and the composition of matter includes from about 16 to about 20 wt % chromium, greater than 6 to about 10 wt % aluminum, from about 2 to about 10 wt % iron, less than about 0.04 wt % yttrium, less than about 12 wt % cobalt, less than about 1.0 wt % manganese, less than about 1.0 wt % molybdenum, less than about 1.0 wt % silicon, less than about 0.25 wt % carbon, about 0.03 wt % boron, less than about 1.0 wt % tungsten, less than about 1.0 wt % tantalum, about 0.5 wt % titanium, about 0.5 wt % hafnium, about 0.5 wt % rhenium, about 0.4 wt % lanthanide elements, and the balance being nickel and incidental impurities. The article formed of the herein described nickel-based superalloy composition may be used in superalloy articles, such as a blade, nozzle, a shroud, a splash plate, a squealer tip of the blade, and a combustor of a gas turbine engine.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

FIG. 1 is a perspective view of an article, such as a gas turbine blade, according to an embodiment of the invention.

DETAILED DESCRIPTION OF THE INVENTION

This invention describes the chemistry of a Ni-based superalloy for turbine component and turbine blade applications. The superalloy provides increased oxidation resistance, lower density, low rhenium and ruthenium content, low cost, improved SPLCF resistance, and less SRZ formation compared to known alloys. The improvement of oxidation resistance was achieved by balancing the strength, oxidation and creep resistance of the alloys through controlling the amount of aluminum and iron, and by controlling the volume fraction of gamma prime phase by controlling the concentration of Al, Ta, Hf. The invention is described in various exemplary embodiments.

Referring to the drawings, FIG. 1 depicts a component of a gas turbine, illustrated as a gas turbine blade 10. The gas turbine blade 10 includes an airfoil 12, a laterally extending platform 16, an attachment 14 in the form of a dovetail to attach the gas turbine blade 10 to a turbine disk or wheel (not shown). In some components, a number of cooling channels extend through the interior of the airfoil 12, ending in openings 18 in the surface of the airfoil 12. The top (or outer radial) portion of the blade is referred to as the squealer tip 20. The squealer tip 20 is one region that is subjected to high thermal temperatures and rubs resulting in potential durability problems in the form of cracking due to thermally induced stress and material loss due to oxidation. If damage such as this occurs the squealer tip 20 needs to be serviced and will require a build-up of new material. For example, a superalloy material can be welded onto the existing portions of the squealer tip 20 to bring it back into the desired shape.

In on aspect, the component article 10 is substantially a single crystal. That is, the component article 10 is at least about 80 percent by volume, and more preferably at least about 95 percent by volume, a single grain with a single crystallographic orientation. There may be minor volume fractions of other crystallographic orientations and also regions separated by low-angle boundaries. The single-crystal structure is prepared by the directional solidification of an alloy composition, usually from a seed or other structure that induces the growth of the single crystal and single grain orientation.

The use of exemplary alloy compositions discussed herein is not limited to the gas turbine blade 10, and it may be employed in other articles such as gas turbine nozzles, vanes, shrouds, or other components for gas turbines.

It is believed that the exemplary embodiments disclosed herein provide a unique superalloy for improved oxidation resistance, SPLCF and rupture resistance. Table I below provides exemplary concentration ranges in weight percent for the elements included in the alloy of the invention. All amounts provided as ranges, for each element, should be construed to include endpoints and sub-ranges.

TABLE I

Exemplary Weight Percent Ranges

| Element | Min. wt % | Max. wt % |
|---|---|---|
| Chromium (Cr) | 16 | 20 |
| Aluminum (Al) | >6 | 10 |
| Iron (Fe) | 2 | 10 |
| Yttrium (Y) | 0 | 0.04 |
| Cobalt (Co) | 0 | 12 |
| Mangenese (Mn) | 0 | 1 |
| Molybdenum (Mo) | 0 | 1 |
| Silicon (Si) | 0 | 1 |
| Carbon (C) | 0 | 0.25 |
| Boron (B) | 0 | 0.03 |
| Tungsten (W) | 0 | 1 |
| Tantalum (Ta) | 0 | 1 |
| Titanium (Ti) | 0 | 0.5 |
| Hafnium (Hf) | 0 | 0.5 |
| Rhenium (Re) | 0 | 0.5 |
| Elements 57-71 (La-Lu) | 0 | 0.04 |
| Nickel (Ni) | Balance | Balance |

Exemplary embodiments disclosed herein may include aluminum to provide improved SPLCF resistance and oxidation resistance. Exemplary embodiments may include from greater than 6 to about 10 wt % aluminum. Other exemplary embodiments may include from about 6.5 to about 9.5 wt % aluminum, 6.1 to about 10 wt % aluminum, about 6.2 to about 10 wt % aluminum, about 6.3 to about 10 wt % aluminum, about 6.3 to about 10 wt % aluminum, about 6.4 to about 10 wt % aluminum, or about 6.5 to about 10 wt % aluminum. Other exemplary embodiments may include from about 7.0 to about 9.0 wt % aluminum. Other exemplary embodiments may include from about 7.5 to about 8.5 wt % aluminum.

Exemplary embodiments disclosed herein include a composition in which two times the aluminum wt % content is less than or equal to the iron wt % content plus 17 wt %. As one example, if the aluminum wt % is 10, then the iron wt % is greater than or equal to 3 wt % (with 10 wt % being a maximum). The equation below illustrates the Al—Fe wt % relationship in the inventive alloy.

$$2*(\text{Al wt \%}) \leq (\text{Fe wt \%})+17 \quad \text{(Equation 1)}$$

Exemplary embodiments disclosed herein may include chromium to improve hot corrosion resistance. The role of chromium is to promote $Cr_2O_3$ formation on the external surface of an alloy. The more aluminum is present, the more protective oxide, $Cr_2O_3$, is formed. Exemplary embodiments may include from about 16 to about 20 wt % chromium. Other exemplary embodiments may include from about 17 to about 19 wt % chromium. Other exemplary embodiments may include from about 17.5 to about 18.5 wt % chromium.

Exemplary embodiments disclosed herein may include iron to improve the yield strength and weldability. With the increase of the Al content, gamma prime volume fraction is increased in the nickel-base precipitated strengthened superalloy, and the ductility-dip will be located in the sensitive temperature range and cause strain cracking in the weld metals, therefore, the addition of a proper Fe content will improve the elongation and yield strength, and therefore, improve the weldability. However, with the increase of Fe content, the oxidization resistance will degrade, so, a formula between the Al and Fe is required to obtain the optimum oxidization resistance and weldability. Exemplary embodiments may include from about 2 to about 10 wt % iron. Other exemplary embodiments may include from about 4 to about 8 wt % iron. Other exemplary embodiments may include from about 5 to about 7 wt % iron.

Exemplary embodiments disclosed herein may include yttrium to impart oxidization resistance and stabilize the gamma prime. With the addition of a little amount of Y, the oxidization resistance of the superalloy was improved significantly, and the surface morphology of the oxidization film was ameliorated. Y is found to be fully segregated at the grain boundaries and changes grain boundary precipitate morphologies, where it eliminates O impurities from grain boundaries. Yttrium could promote the oxide of Al formation and decreased the proportion of NiO. Yttrium increased the coherence between the oxide scale and the alloy substrate to decrease the spallation of oxide scale. Exemplary embodiments may include from about 0 to about 0.04 wt % yttrium. Other exemplary embodiments may include yttrium in amounts from about 0 to about 0.02 wt %.

Exemplary embodiments disclosed herein may include cobalt to raise solvus temperature of gamma prime. Exemplary embodiments may include from about 0 to about 12 wt % cobalt. Other exemplary embodiments may include from about 2 to about 10 wt % cobalt. Other exemplary embodiments may include from about 4 to about 8 wt % cobalt. Other exemplary embodiments may include from about 5 to about 7 wt % cobalt.

Exemplary embodiments disclosed herein may include manganese to impart solid solution strengthening. Exemplary embodiments may include from 0 to about 1 wt % molybdenum. Other exemplary embodiments may include manganese in amounts from about 0 to about 0.5 wt %.

Exemplary embodiments disclosed herein may include molybdenum to impart solid solution strengthening. Exemplary embodiments may include from 0 to about 1 wt % molybdenum. Other exemplary embodiments may include molybdenum in amounts from about 0 to about 0.5 wt %.

Exemplary embodiments disclosed herein may include silicon. Exemplary embodiments may include from 0 to about 1.0 wt % silicon.

Exemplary embodiments disclosed herein may include carbon. Exemplary embodiments may include from 0 to about 0.25 wt % carbon. Other exemplary embodiments may include from 0 to about 0.12 wt % carbon.

Exemplary embodiments disclosed herein may include boron to provide tolerance for low angle boundaries. Exemplary embodiments may include from 0 to about 0.03 wt % boron. Other exemplary embodiments may include from 0 to about 0.015 wt % boron.

Exemplary embodiments disclosed herein may include tungsten as a strengthener. Exemplary embodiments may include from 0 to about 1 wt % tungsten. Other exemplary embodiments may include tungsten in amounts from 0 to about 0.5 wt %. Other exemplary embodiments may include tungsten in amounts from 0 to about 0.25 wt %.

Exemplary embodiments disclosed herein may include a small percentage of tantalum to promote gamma prime strength. Exemplary embodiments may include from 0 to about 1.0 wt % tantalum.

Exemplary embodiments disclosed herein may include a small percentage of titanium. Exemplary embodiments may include from 0 to about 0.5 wt % titanium.

Exemplary embodiments disclosed herein may optionally include hafnium. Hafnium may improve the life of thermal barrier coatings. Exemplary embodiments may include from 0 to about 0.5 wt % hafnium. Other exemplary embodiments may include from 0 to about 0.25 wt % hafnium.

Exemplary embodiments disclosed herein may include small amounts of rhenium, which is a potent solid solution strengthener that partitions to the gamma phase, and also is a slow diffusing element, which limits coarsening of the gamma prime. Exemplary embodiments may include from 0 to about 0.5 wt % rhenium. Other exemplary embodiments may include rhenium at levels between 0 to about 0.25 wt %.

Exemplary embodiments disclosed herein may include one or more of the lanthanide elements (elements 57 to 71 in the periodic table). Exemplary embodiments may include from 0 to about 0.04 wt % lanthanide elements. Other exemplary embodiments may include from 0 to about 0.02 wt % lanthanide elements.

Exemplary embodiments disclosed herein may include nickel. Exemplary embodiments may include a balance of the composition comprising nickel and other trace or incidental impurities, so that the total wt % of the composition elements equals 100%.

According to an exemplary embodiment, a composition of matter or an article comprises from about 16 to about 20 wt % chromium, more than 6 wt % to about 10 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 7 wt % to about 10 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 8 wt % to about 10 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 9 wt % to about 10 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 6.1 wt % to about 10 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 6.5 wt % to about 9.5 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 7 wt % to about 9 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

According to another exemplary embodiment, a composition of matter or an article comprises from about 16 to about 20 wt % chromium, about 7.5 wt % to about 8.5 wt % aluminum, from about 2 to about 10 wt % iron, from 0 to about 0.04 wt % yttrium, from about 0 to about 12 wt % cobalt, from 0 to about 1 wt % manganese, from 0 to about 1 wt % molybdenum, from 0 to about 1 wt % silicon, from 0 to about 0.25 wt % carbon, from 0 to about 0.03 wt % boron, from 0 to about 1 wt % tungsten, from 0 to about 1 wt % tantalum, from 0 to about 0.5 wt % tantalum, from 0 to about 0.5 wt % hafnium, from 0 to about 0.5 wt % rhenium, from 0 to about 0.04 wt % lanthanide elements, with the balance being comprised of nickel and incidental impurities, so that the total wt % of the composition equals 100.

The composition of matter herein described have a gamma prime solvus temperature of 2,000° F. or greater, or a gamma prime solvus temperature of about 2,000° F. to about 2,100° F. In addition, the composition of matter herein described has a gamma prime volume fraction of about 76% to about 90%, or of about 82% to about 88%. The advantages of the improved gamma prime solvus temperature and gamma prime volume fraction are an alloy having good mechanical properties and oxidization resistance at elevated temperatures.

Exemplary embodiments disclosed herein include an article, such as a blade, nozzle, a shroud, a squealer tip, a splash plate, and a combustor of a gas turbine, comprising a composition as described above. In addition, a composition or alloy as described above exhibits excellent weldability, which greatly facilitates repair and service of existing parts, components or articles.

The primary technical advantages of the alloys herein described are excellent oxidization resistance because of the higher Al and proper Y addition, and excellent weldability due to the optimum relationship between Al and Fe. Even though Al is in the range between >6.0-10.0 from the current testing, no fissures were observed in the weld metals.

The exemplary embodiments describe the compositions and some characteristics of the alloys, but should not be interpreted as limiting the invention in any respect. Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. The terms "about" and "approximately" as applied to a particular value of a range applies to both values, and unless otherwise dependent on the precision of the instrument measuring the value, may indicate +/−10% of the stated value(s).

This written description uses exemplary embodiments to disclose the invention, including the best mode, and also to enable any person skilled in the art to make and use the invention. The patentable scope of the invention is defined by the claims, and may include other exemplary embodiments that occur to those skilled in the art. Such other exemplary embodiments are intended to be within the scope of the claims if they have structural elements that do not differ from the literal language of the claims, or if they include equivalent structural elements with insubstantial differences from the literal languages of the claims.

What is claimed is:

1. A composition of matter comprising:

from about 16 to about 20 wt % chromium;

greater than 6 to about 10 wt % aluminum;

from about 2 to about 10 wt % iron;

less than about 0.04 wt % yttrium;

less than about 12 wt % cobalt;

less than about 1.0 wt % manganese;

less than about 1.0 wt % molybdenum;

less than about 1.0 wt % silicon;

less than about 0.25 wt % carbon;
about 0.03 wt % boron;
less than about 1.0 wt % tungsten;
less than about 1.0 wt % tantalum;
about 0.5 wt % titanium;
about 0.5 wt % hafnium;
about 0.5 wt % rhenium;
about 0.4 wt % lanthanide elements; and
balance nickel and incidental impurities.

2. The composition of matter of claim 1, wherein two times the aluminum wt % content is less than or equal to the iron wt % content plus 17 wt %.

3. The composition of matter of claim 1, wherein aluminum is present in amounts from about 6.5 to about 10 wt %.

4. The composition of matter of claim 1, wherein aluminum is present in amounts from about 7.0 to about 9.0 wt %.

5. The composition of matter of claim 1, wherein aluminum is present in amounts from about 7.5 to about 8.5 wt %.

6. The composition of matter of claim 1, wherein the composition has a gamma prime solvus temperature of 2,000° F. or greater.

7. The composition of matter of claim 1, wherein the composition has a gamma prime solvus temperature of about 2,000° F. to about 2,100° F.

8. The composition of matter of claim 1, wherein the composition has a gamma prime volume fraction of about 76% to about 90%.

9. The composition of matter of claim 1, wherein the composition has a gamma prime volume fraction of about 82% to about 88%.

10. An article comprising a composition, the composition comprising:
from about 16 to about 20 wt % chromium;
greater than 6 to about 10 wt % aluminum;
from about 2 to about 10 wt % iron;
less than about 0.04 wt % yttrium;
less than about 12 wt % cobalt;
less than about 1.0 wt % manganese;
less than about 1.0 wt % molybdenum;
less than about 1.0 wt % silicon;
less than about 0.25 wt % carbon;
about 0.03 wt % boron;
less than about 1.0 wt % tungsten;
less than about 1.0 wt % tantalum;
about 0.5 wt % titanium;
about 0.5 wt % hafnium;
about 0.5 wt % rhenium;
about 0.4 wt % lanthanide elements; and
balance nickel and incidental impurities.

11. The article of claim 10, wherein the article is a blade of a gas turbine, or a squealer tip of the blade.

12. The article of claim 10 wherein the article is a component of a gas turbine selected from a nozzle, a shroud, a splash plate, and a combustor component.

13. The article of claim 10, wherein two times the aluminum wt % content is less than or equal to the iron wt % content plus 17 wt %.

14. The article of claim 10, wherein aluminum is present in amounts from about 6.5 to about 9.5 wt %.

15. The article of claim 10, wherein aluminum is present in amounts from about 7.0 to about 9.0 wt %.

16. The article of claim 10, wherein aluminum is present in amounts from about 7.5 to about 8.5 wt %.

17. The article of claim 10, wherein the composition has a gamma prime solvus temperature of 2,000° F. or greater.

18. The article of claim 10, wherein the composition has a gamma prime solvus temperature of about 2,000° F. to about 2,100° F.

19. The article of claim 10, wherein the composition has a gamma prime volume fraction of about 76% to about 90%.

20. The article of claim 10, wherein the composition has a gamma prime volume fraction of about 82% to about 88%.

* * * * *